343-700 MS AU 256 EX
8/2/77 OR 4,040,060

United States Patent [19]
Kaloi

[11] 4,040,060
[45] Aug. 2, 1977

[54] NOTCH FED MAGNETIC MICROSTRIP DIPOLE ANTENNA WITH SHORTING PINS

[75] Inventor: Cyril M. Kaloi, Thousand Oaks, Calif.

[73] Assignee: The United States of America as represented by the Secretary of the Navy, Washington, D.C.

[21] Appl. No.: 740,697

[22] Filed: Nov. 10, 1976

[51] Int. Cl.[2] ..... H01Q 1/38; H01Q 9/28
[52] U.S. Cl. ..... 343/700 MS; 343/846
[58] Field of Search ..... 343/700 MS, 846, 822, 343/795, 769, 708

[56] References Cited

U.S. PATENT DOCUMENTS 3,947,850 3/1976 Kaloi ..... 343/846

*Primary Examiner*—Alfred E. Smith
*Assistant Examiner*—David K. Moore
*Attorney, Agent, or Firm*—Richard S. Sciascia; Joseph M. St.Amand

[57] ABSTRACT

A notch fed magnetic microstrip dipole antenna consisting of a thin electrically conducting, rectangular-shaped radiating element formed on one surface of a dielectric substrate, the ground plane being on the opposite surface with the radiating element shorted to the ground plane. The length of the element determines the resonant frequency. The feed point is located in a notch along the centerline of the antenna length and the input impedance can be varied by moving the feed point along the centerline of the antenna without affecting the radiation pattern. The notch extends from an edge of the element to the feed point. The element is shorted through the dielectric to the ground plane by means of plated thru holes or rivets at one end of the element.

13 Claims, 14 Drawing Figures

NOTCH FED MAGNETIC MICROSTRIP DIPOLE ANTENNA WITH SHORTING PINS

This invention is realted to U.S. Pat. No. 3,947,850 issued Mar. 30, 1976 for NOTCH FED ELECTRIC MICROSTRIP DIPOLE ANTENNA, by Cyril M. Kaloi and commonly assigned.

This invention is also related to copending U.S. Pat. Applications:

- Ser. No. 740,695 for ASYMMETRICALLY FED MAGNETIC MICROSTRIP DIPOLE ANTENNA;
- Ser. No. 740,693 for OFFSET FED MAGNETIC MICROSTRIP DIPOLE ANTENNA;
- Ser. No. 740,691 for COUPLED FED MAGNETIC MICROSTRIP DIPOLE ANTENNA;
- Ser. No. 740,694 for ELECTRIC MONOMICROSTRIP DIPOLE ANTENNAS;
- Ser. No. 740,690 for TWIN ELECTRIC MICROSTRIP DIPOLE ANTENNAS;
- Ser. No. 740,696 for NOTCHED/DIAGONALLY FED ELECTRIC MICROSTRIP DIPOLE ANTENNA; and
- Ser. No. 740,692 for CIRCULARLY POLARIZED ELECTRIC MICROSTRIP ANTENNAS;

all filed together herewith on Nov. 10, 1976, by Cyril M. Kaloi, and commonly assigned.

SUMMARY OF THE INVENTION

The present antenna is one of a family of new microstrip antennas and uses a very thin laminated structure which can readily be mounted on flat or curved irregular structures, presenting low physical profile where minimum aerodynamic drag is required. The specific type of microstrip antenna described herein is the "notch fed magnetic microstrip dipole." This antenna can be arrayed with interconnecting microstrip feed lines as part of the element. Therefore, the antenna element and the feed lines can be photo-etched simultaneously. Using this technique, only one coaxial-to-microstrip adapter is required to interconnect an array with a transmitter or receiver. In addition, this antenna can be easily matched to most practical impedances by varying the location of the feed point along the length of the element. Of the many types of microstrip antennas, this type antenna offers the best advantages as far as arraying of the elements are concerned.

Reference is made to the "magnetic microstrip dipole" instead of simply the "microstrip dipole" to differentiate between two basic types; one being the magnetic microstrip type, and the other being the electric microstrip type. The notch fed magnetic microstrip dipole antenna belongs to the magnetic microstrip type antenna. The magnetic microstrip antenna consists essentially of a conducting strip called the radiating element and a conducting ground plane separated by a dielectric substrate, with the radiating element having one end shorted to the ground plane. The shorting of the radiating element to the ground plane can be accomplished by electroplating through a series of holes or by means of rivets. The length of the radiating element is approximately ¼ wavelength. The element width can be varied depending on the desired electrical characteristics. The copper losses in the clad material and the width of the notch determines how narrow the element can be made. The purpose of the notch feed point is to interconnect any array of elements at the elements' optimum feed point using microstrip transmission lines and/or stripline transmission lines. The conducting ground plane is usually greater in length and width than the radiating element.

The magnetic microstrip antenna's physical properties are somewhat similar to those of the electric microstrip antenna, with the exceptions that the radiating element is only one-half the size of the electric microstrip antenna (i.e., approximately ¼ wavelength in length whereas the electric microstrip antenna is ½ wavelength in length) and that the radiating element has one end shorted to ground in the magnetic microstrip antenna. However, the electrical characteristics of the magnetic microstrip antenna are quite different from the electric microstrip antenna, as will be hereinafter shown.

The thickness of the dielectric substrate in the magnetic microstrip antenna should be much less than ¼ the wavelength For thickness approaching ¼ the wavelength, the antenna radiates in a monopole mode in addition to radiating in a microstrip mode.

The antenna as hereinafter described can be used in missiles, aricraft and other type applications where a low physical profile antenna is desired. The present type of antenna element provides completely different radiation patterns and can be arrayed to provide near isotropic radiation patterns for telemetry, radar, beacons, tracking, etc. By arraying the present antenna with several elements, more flexibility in forming radiation patterns is permitted. In addition, the antenna can be designed for any desired frequency within a limited bandwidth, preferably below 25 GHz, since the antenna will tend to operate in a hybrid mode (e.g., a microstrip/monopole mode) above 25 GHz for most commonly used stripline materials. However, for clad materials thinner than 0.031 inch, higher frequencies can be used and still maintain the microstrip mode. The design technique used for this antenna provides an antenna with ruggedness, simplicity, low cost, a low physical profile, and conformal arraying capability about the body of a missile or vehicle where used including irregular surfaces, while giving excellent radiation coverage. The antenna can be arrayed over an exterior surface without protruding, and be thin enough not to affect the airfoil or body design of the vehicle. The thickness of the present antenna can be held to an extreme minimum depending upon the bandwidth requirement; antennas as thin as 0.005 inch for frequencies above 1,000 MHz have been successfully produced. Due to its conformability, this anetnna can be applied readily as a wrap around band to a missile body without the need for drilling or injuring the body and without interfering with the aerodynamic design of the missile. In the present antenna, the antenna element is grounded to the ground plane and the antenna is easily matched to most practical impedances by varying the location of the feed point along the length of the element.

Advantages of an antenna of this type over other similar appearing types of microstrip antennas is that the present antenna can be fed very easily from the ground plane side as well as the element side.

The notch fed magnetic microstrip dipole antenna consists of a thin, electrically-conducting, rectangular-shaped element formed on the surface of a dielectric substrate. The element has a notch extending from one end thereof along the center-line of the length to the feed point. The ground plane is on the opposite surface of the dielectric substrate and the microstrip antenna element can be fed directly at the feed point from a coaxial-to-microstrip adapter, with the center pin of the adapter extending through the ground plane and dielectric substrate to the antenna element. However, the notch design allows feeding at the optimum feed point with microstrip transmission line that can be etched along with the element. In the present antenna one end of the element is shorted to the ground plane. This allows a smaller antenna to be constructed for the same resonant frequency as would be available from an electric microstrip antenna. The length of the antenna element determines the resonant frequency. The feed point is located on the centerline along the antenna length. While the input impedance will vary as the feed point is moved along the centerline between the antenna center point and the end of the antenna in either direction, the radiation pattern will not be affected by moving the feed point. The antenna bandwidth increases with the width of the element and the spacing (i.e., thickness of dielectric) between the ground plane and the element; the spacing has a somewhat greater effect on the bandwidth than the element width. The radiation pattern changes very little within the bandwidth of operation.

The copper losses in the clad material and the width of the notch determines how narrow the element can be made. The width of the notch has a slight effect on the resonant frequency, as the notch width is increased the resonant frequency is increased, and vice versa. The notch feed system allows interconnection of any array of elements at the optimum feed point of each element, using microstrip transmission lines. The width of the notch is usually determined by the desired widths of the microstrip transmission line. The length of the notch also has a slight effect on the resonant frequency.

Design equations sufficiently accurate to specify a few of the design properties of the notch fed magnetic dipole antenna are discussed later. These design properties are the input impedance, radiation resistance, the bandwidth, the efficiency and the antenna element dimensions as a function of the frequency. Calculations have been made using such equations, and typical notched fed magnetic microstrip dipole antennas have been built using the calculated results, and actual measurements of the fields, gain, and polarization have been made.

DESCRIPTION AND OPERATION

Figure 1A:
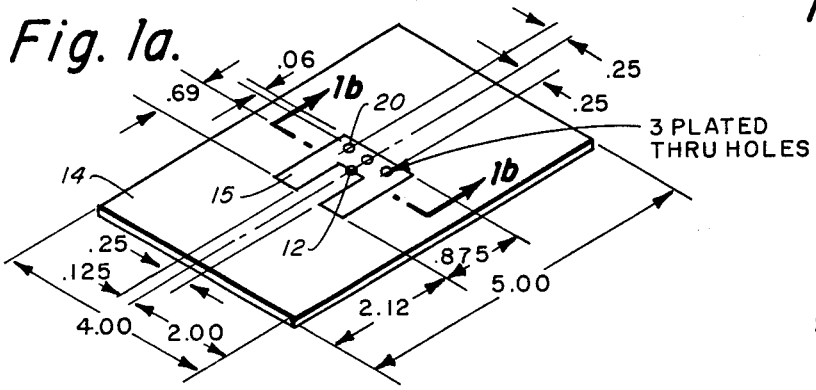
FIG. 1*a* is an isometric planar view of a typical square notch fed electric microstrip dipole antenna.
Figure 1C:
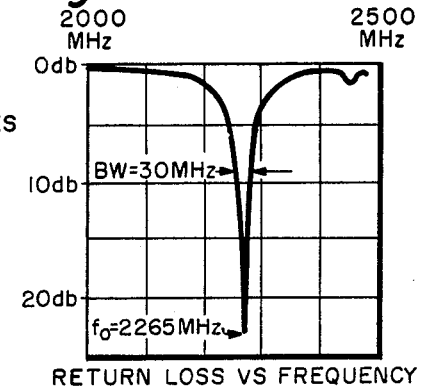
FIG. 1*c* is a plot showing the return loss versus frequency for a square element antenna having the dimensions shown in FIGS. 1*a* and 1*b*.
Figure 1B:
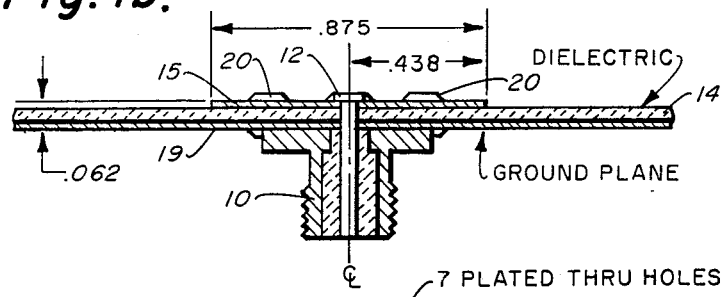
FIG. 1*b* is a cross-sectional view taken along section line B—B of FIG. 1*a*.
Figure 2A:
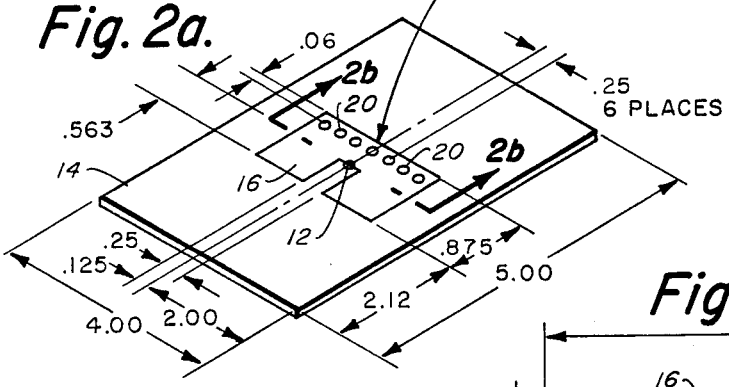
FIG. 2*a* is an isometric planar view of a typical rectangular notch fed electric microstrip dipole antenna.
Figure 2B:
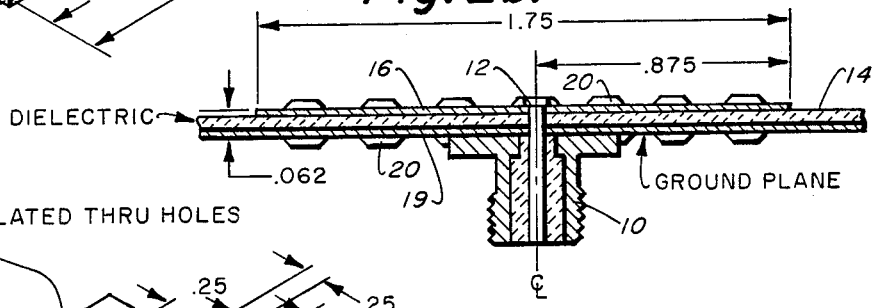
FIG. 2*b* is a cross-section view taken along section line B—B of FIG. 2*a*.
Figure 4:
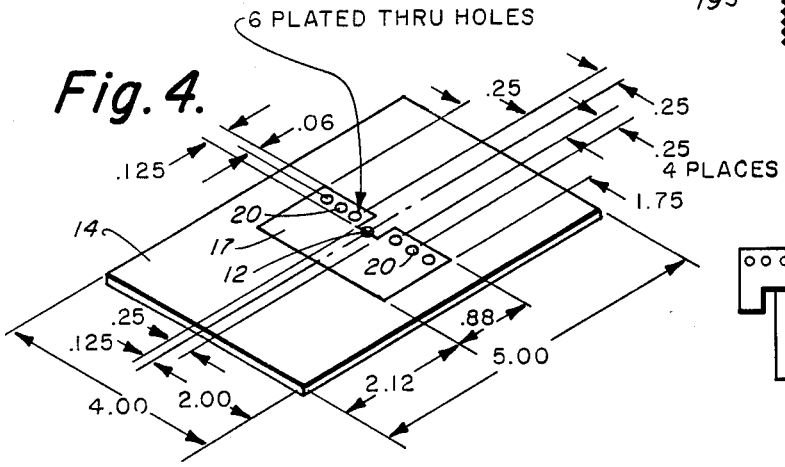
FIG. 4 is an isometric planar view of a typical notch fed antenna notched at the shorted end of the radiating element.
Figure 3:
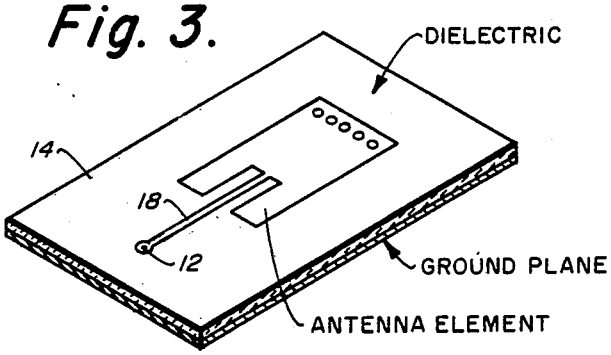
FIG. 3 shows a typical rectangular notch fed electric microstrip dipole antenna where the coaxial-to-microstrip adapter is at a location other than the optimum feed point and a microstrip feed line is used to connect the optimum feed point to the center pin of the adapter.

FIGS. 1*a* and 1*b* show a typical square notch fed magnetic microstrip dipole antenna of the present invention. FIGS. 2*a* and 2*b* show a rectangular notch fed electric microstrip dipole antenna. The only physical differences in the above antennas are the element width and notch length (i.e., the location of the feed point). The electrical difference is that the wider antenna element has a slightly greater bandwidth. These two typical antennas are illustrated with the dimensions given in inches, as shown in FIGS. 1*a* and 1*b*, and 2*a* and 2*b*, by way of example, and curves shown in later figures are for typical antennas illustrated. The antenna is fed from a coaxial-to-microstrip adapter 10, with the center pin 12 of the adapter extending through the dielectric substrate 14 to the feed point no microstrip element 15 or 16. If it is desired to have the coaxial-to-microstrip adapter at a location other than the optimum feed point, a microstrip feed line 18 can be used to bridge this gap between the optimum feed point and the center pin 12 of the adapter, as shown by way of example in the configuration of FIG. 3 or the array of FIG. 9. The microstrip feed lines and interconnecting lines can be etched along with the elements in much the same manner as in printed circuit techniques. The microstrip antenna can be fed with most of the different types of coaxial-to-microstrip launchers presently available. FIG. 4 shows a notch fed magnetic microstrip antenna which is notched at the shorted end of the element and fed at the optimum feed point. The advantage of notching from the shorted end is to reduce the overall size of the notch when the optimum feed point is located nearer the shorted end of the element. The smaller the notch size, the less conducting metal is removed from the element, and thus any change in resonant frequency due to notching will be smaller. Dielectric substrate 14 separates the elements 15, 16 and 17 from the ground plane 19 electrically. The elements are shorted to the ground plane by means of rivets or plated thru holes 20, as shown in the drawings.

Figure 2C:
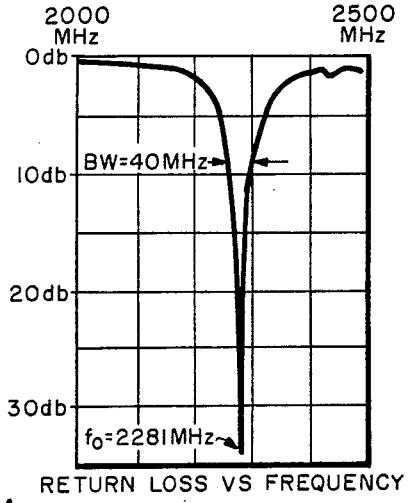
FIG. 2*c* is a plot showing the return loss versus frequency for a rectangular element antenna having the dimensions as shown in FIGS. 2*a* and 2*b*.

FIGS. 1*c* and 2*c* show plots of return loss versus frequency (which are indications of bandwidth) for the square element 15 and rectangular element 16, respectively. The square type element is the limit as to how wide the element can be without exciting higher order modes of radiation. With a square element, as in FIGS. 1*a* and 1*b*, mode degeneracy may occur if the feed point is not located at the center of the width. The result of mode degeneracy is undesired polarization. The copper losses in the clad material and the width of the notch determine how narrow the element can be made. The length of the element determines the resonant frequency of the antenna, which will be further discussed later. It is preferred that both the length and the width of the ground plane be at least one wavelength (λ) in dimension beyond each edge of the element to minimize backlobe radiation.

Figure 9:
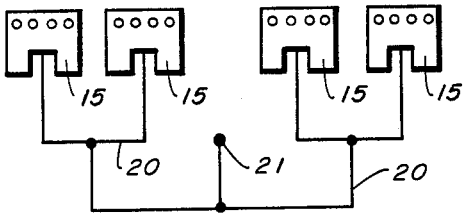
FIG. 9 shows a general arraying configuration using a plurality of notch fed antenna elements with a network of microstrip transmission lines.
Figure 5:
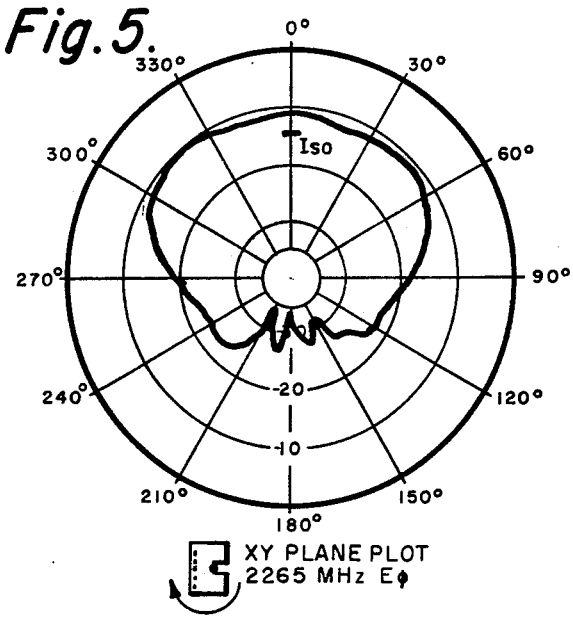
FIG. 5 shows the antenna radiation pattern (XY-Plane plot) for the square element antenna shown in FIGS. 1*a* and 1*b*.
Figure 6:
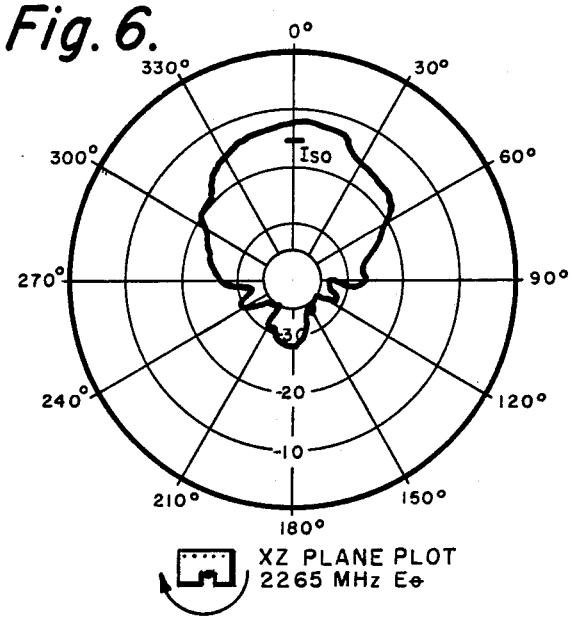
FIG. 6 shows the antenna radiation pattern (XZ-Plane plot) for the square element antenna shown in FIGS. 1*a* and 1*b*.
Figure 7:
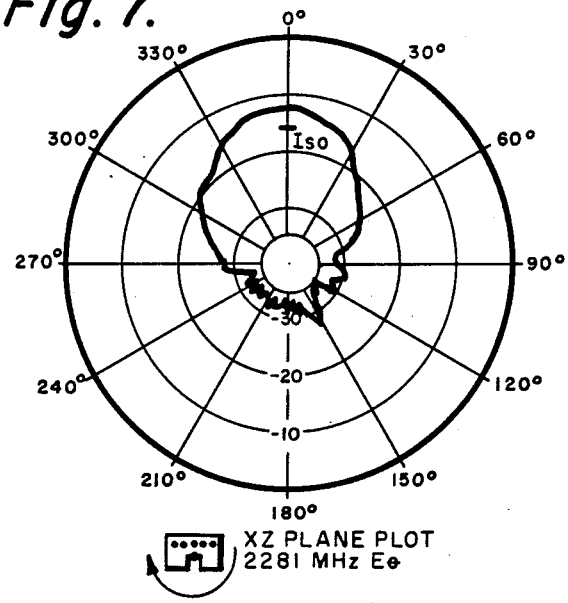
FIG. 7 shows the antenna radiation pattern (XY Plane plot) for the rectangular element antenna shown in FIGS. 2*a* and 2*b*.
Figure 8:
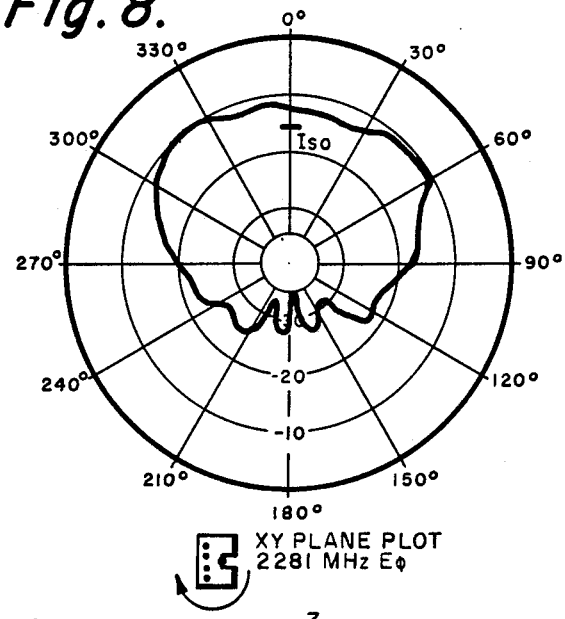
FIG. 8 shows the antenna radiation pattern (XZ-Plane plot) for the rectangular element antenna shown in FIGS. 2*a* and 2*b*.

FIGS. 5 and 6 show antenna radiation patterns for the XY and XZ planes for the square element having the dimensions of FIGS. 1*a* and 1*b*. FIGS. 8 and 9 show similar patterns of the XY and XZ planes for the rectangular element having the dimensions of FIGS. 2*a* and 2*b*.

A plurality of microstrip antenna elements can be arrayed on a dielectric substrate 14 by using microstrip transmission line 20, such as diagrammatically illustrated in FIG. 9 and fed from a single coaxial-to-microstrip connector at 21.

Pertinent design equations that are sufficient to characterize this type of antenna are presented below.

DESIGN EQUATIONS

To a system designer, the properties of an antenna most often required are the input impedance, gain, bandwidth, efficiency, polarization, and radiation pattern. The antenna designer needs to know the above-mentioned properties and also the antenna element dimension as a function of frequency.

Figure 10:
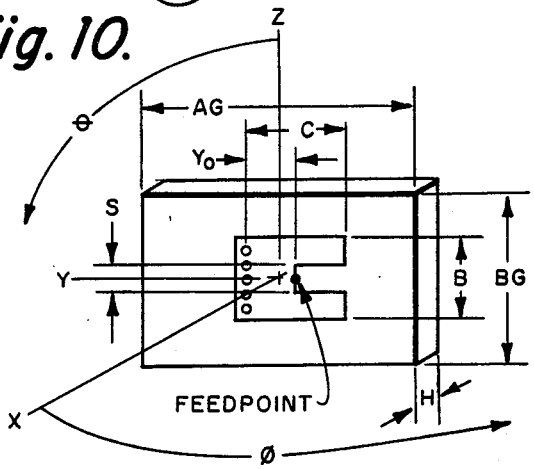
FIG. 10 illustrates the alignment coordinate system used for the notch fed electric microstrip dipole antenna.

The coordinate system used and the alignment of the antenna element within this coordinate system are shown in FIG. 10. The coordinate system is in accordance with the IRIG Standards and the alignment of the antenna element was made to coincide with the autual antenna patterns that were shown earlier. The B dimension is the width of the antenna element. The C dimension is the effective length of the antenna element measured from the short to the opposite end, as shown in FIG. 10. The H dimension is the height of the antenna element above the ground plane and also the thickness of the dielectric. The AG dimension and the BG dimension are the length and the width of the ground plane, respectively. The $Y_o$ dimension is the location of the feed point measured along the centerline from the point the antenna element is shorted to ground, as shown. The S dimension is the width of the notch. The angles $\theta$ and $\phi$ are measured per IRIG Standards. The above parameters are measured in inches and degrees.

ANTENNA ELEMENT DIMENSION

The equation for determining the length of the antenna element is given by $$C = \frac{\left[1.18 \times 10^{10} - F \times 4 \times H \times \sqrt{\epsilon}\right]}{\left[4 \times F \times \sqrt{1 + 0.61 \times (\epsilon - 1) \times \left(\frac{B - S}{H}\right)^{0.1155}}\right]}$$

where $x$ = indicates multiplication $F$ = center frequency (Hz)

$\epsilon$ = the dielectric constant of the substrate (no units).

In the above equation, the term (B-S) is referred to as the effective width of the element. As mentioned earlier, a greater bandwidth is observed when using a wider B dimension. For a wider bandwidth, it would be best to maintain a narrow notch dimension.

The main purpose of the notch feed system is to interconnect an array of elements at the elements' optimum feed point using microstrip transmission lines. Tests have shown that a notch width equal to twice the microstrip transmission line width has very little effect on the antenna properties.

In most practical applications, B, F, H and $\epsilon$ are usually given. However, it is sometimes desirable to specify B as a function of C as in a square element. As seen from equation (1), a closed form solution is not possible for the square element. However, numerical solution can be accomplished by using Newton's Method of successive approximation (see U.S. National Bureau of Standards, Handbook Matermatical Functions, Applied Mathematics Series 55, Washington, D.C., GPO, November 1964) for solving equation (1). Equation (1) is obtained by fitting curves to Sobol's equation (Sobol, H., "Extending IC Technology to Mircrowave Equipment," ELECTRONICS, Vol. 40, No. 6 (Mar. 20, 1967), pp. 112–124). The modification was needed to account for end effects and also the effects of the notch when the microstrip transmission line is used as an antenna element. Sobol obtained his equation by fitting curves to Wheeler's conformal mapping analysis (Wheeler, H., "Transmission Line Properties of Parallel Strips Separated by a Dielectric Sheet," IEEE TRANSACTIONS, Microwave Theory Technique, Vol. MTT-13, No. 2 March 1965, pp. 172–185).

As was indicated, the length C of the antenna radiating element is that dimension measured from the short (i.e., the center of the rivets or plated-thru holes) to the opposite end of th element, as shown in FIG. 10. The number and spacing of the shorting rivets or plated-thru holes an be varied without affecting the proper operation of the antenna. The more shorts along the short line, however, the greater will be the accuracy of the equation for the length, C. More or less shorts than shown in the figures of drawing can be used; the number shown in the drawings, however, operate very satisfactorily. The rivets and plated-thru holes are similar to those used in printed circuits.

The grounding rivets or plated-thru holes operate effectively for shorting the radiating element to the ground plane, as shown in the drawings. The size of the rivet or plated-thru holes can be varied. However, as the diameter of the rivet or plated-thru hole is increased, this will shorten the effective length of the radiating element thereby increasing the center frequency. Conversely, decreasing the diameter will increase the effective length of the radiating element and thereby decrease the center frequency of the antenna. The rivets or plated-thru holes are normally close to the edge of the shorted end of the antenna element. As long as the distance between the rivet or plated-thru hole and the shorted end of the element strip is a very small fraction of the wavelength the operation of the antenna will not be affected.

Derivation of design equations mentioned eariler, requires having an expression for the $E_\theta^2$ and $E_\phi^2$ power fields. The $E_\theta$field and the $E_\phi$field for the "Notch Fed Magnetic Microstrip Dipole Antenna" are very complex. The reasons are that five modes of oscillation dipole moment alignment occur on the element. These oscillating dipole moments occur between the edges of the element and the ground plane along the four edges, in addition to the oscillating dipole moments broadside to the element.

However, it has been shown that if only one oscillating "cavity current" mode takes place, the radiation resistance for the element may be derived by assuming that all the power occurs in one oscillating dipole moment mode, since the radiation resistance, $R_a$, is given by the total radiated power, W, divided by the effective oscillating cavity current $I_{eff}$. Although this technique does not give an accurate calculated shape of the radiation pattern, the gain or the polarization of the antenna element, it does provide the total power radiated. The total power radiated is all that is required to determined the other antenna properties such as input impedance, bandwidth and efficiency. Actual fields, antenna gain, and polarization can be obtained by actual measurements, as shown in FIGS. 5, 6, 7 and 8, and therefore equations for these properties are not absolutely required. Nevertheless, to properly obtain equations for the fields, all five oscillating dipole moments mode must be taken into consideration.

If one assumes that all the power occurs in the "dipole moment mode" broadside to the element, by virtue of the image principle one can proceed to derive the equations of radiation resistance, input impedance, bandwidth and efficiency in the same manner as was derived for "Notch Fed Electric Microstrip Dipole Antenna" in aforementioned U.S. Pat. No. 3,947,850 issued Mar. 30, 1976. The antenna element length, C, as a function of frequency, *f*, was derived earlier. However, upon invoking the image principle, the length for the element used in computations for this magnetic mircostrip antenna must be double. Letting $$A = 2C$$

where *A* is the length of the element plus the image length, and having calculated the total power radiated, the properties of this antenna mentioned above can be computed. Equations for the radiation resistance, input impedance, efficiency, and bandwidth given in aforementioned U.S. Pat. No. 3,947,850 can be used to provide reasonably accurate results for the notch fed magnetic microstrip dipole antenna, keeping in mind that $A = 2C$ in these equations.

Typical antennas have been built using the above equations and the calaculated results are in good agreement with test results.

The magnetic microstrip antennas involve major differences in electrical characteristics when compared to the electric microstrip antennas. This is particularly true as to radiation pattern configurations and for location of the feed points for different input matching conditions. Further, the magnetic microstrip antennas are susceptible to complex polarization, which are desirable under certain circumstances.

These complex polarization patterns give a half-donut configuration in the YZ plane completely around the antenna. In addition, in the XY plane there is provided a pattern broadside to the element (i.e., above the ground plane).

Obviously many modifications and variations of the present are possible in the light of the above teachings. It is therefore to be understood that within the scope of the appended claims the invention may be practiced otherwise than as specifically described.

What is claimed is:

1. A notch fed magnetic microstrip dipole antenna having low physical profile and conformal arraying capability, comprising:

a. a thin ground plane conductor;

b. a thin rectangular radiating element having a notch extending into said element from one end thereof along the centerline of the element length, said element being spaced from said ground plane;

c. said radiating element being electrically separated from said ground plane by a dielectric substrate;

d. said radiating element being shorted to the ground plane at one end of the length thereof;

e. said radiating element having an optimum feed input located along the centerline of the length thereof at the inner end of said notch;

f. the length of said radiating element determining the resonant frequency of said antenna;

g. the antenna input impedance being variable to match most practical impedances as said feed point is moved along said centerline without affecting the antenna radiation pattern;

h. the antenna bandwidth being variable with the width of the radiating element and the spacing between said radiating element and said ground plane, the width of said notch being a factor as to the effective width of said element, said spacing between the radiating element and the grond plane having somewhat greater effect on the bandwidth than the element width.

2. An antenna as in claim 1 wherein the ground plane conductor extends at least one wavelength beyond each edge of the element to minimize any possible backlobe radiation.

3. An antenna as in claim 1 wherein said element is shorted to the ground by means of any of rivets and plated-through holes.

4. An antenna as in claim 1 wherein said element is fed with microstrip transmission line.

5. An antenna as in claim 1 wherein said thin rectangular radiating element is in the form of a square, said square element being the limit as to how wide the element can be without exciting higher order modes of radiation.

6. An antenna as in claim 1 wherein a plurality of said radiating elements are arrayed with microstrip transmission lines to provide a near isotropic radiation pattern.

7. An antenna as in claim 1 wherein the length of said radiating element is approximately ¼ wavelength.

8. An antenna as in claim 1 wherein said antenna element feed point is connected directly to an adapter center pin.

9. An antenna as in claim 1 wherein said antenna element optimum feed point is connected to an adapter center pin by means of microstrip transmission line.

10. An antenna as in claim 1 wherein a plurality of said thin rectangular radiating elements are arrayed on one surface of said dielectric substrate.

11. An antenna as in claim 1 wherein the length of the antenna radiating element is determined by the equation:

$$C = \frac{\left[1.18 \times 10^{10} - F \times 4 \times H \times \sqrt{\epsilon}\right]}{\left[4 \times F \times \sqrt{1 + 0.61 \times (\epsilon - 1) \times \left(\frac{B - S}{H}\right)^{0.1155}}\right]}$$

where $C$ is the length to be determined $F$ = the center frequency (Hz)

$B$ = the width of the antenna element $H$ = the thickness of the dielectric $\epsilon$ = the dielectric constant of the substrate $S$ = the width of the notch $B-S$ = the effective width of the antenna element.

12. An antenna as in claim 1 wherein the varying the dimensions of the length and width of said notch has a small effect on varying the resonant frequency of the antenna.

13. An antenna as in claim 1 wherein the minimum width of said radiating element is determined by the equivalent internal resistance of the conductor plus any loss due the dielectric.

* * * * *